United States Patent [19]

Chunn

[11] 4,369,976

[45] Jan. 25, 1983

[54] CARD GAME WITH TRUMP SUITS AND TRUMP WORDS

[76] Inventor: Robert E. Chunn, 1084 Dayton, #301, Aurora, Colo. 80010

[21] Appl. No.: 264,141

[22] Filed: May 15, 1981

[51] Int. Cl.[3] ..... A63F 1/00

[52] U.S. Cl. ..... 273/303; 273/308

[58] Field of Search ..... 273/299, 303, 304, 308

[56] References Cited

U.S. PATENT DOCUMENTS

| | | | |
|---|---|---|---|
| 1,272,480 | 7/1918 | McBride | 273/304 |
| 1,332,249 | 3/1920 | Feero | 273/299 |
| 1,373,115 | 3/1921 | Broderick | 273/304 |
| 1,540,085 | 6/1925 | Partridge | 273/304 |
| 4,234,189 | 11/1980 | Chunn | 273/303 X |

*Primary Examiner*—Anton O. Oechsle

*Attorney, Agent, or Firm*—Edwin L. Spangler, Jr.

[57] ABSTRACT

This invention relates to an improved version of my previously patented card game (U.S. Pat. No. 4,234,189) wherein the deck of fifty-two cards is divided as before into four suits of thirteen cards each; however, I now display on each card of each suit a single trump-determining category or genus effective to distinguish each such suit from the other three. In addition, while I retain the alphabetical indicia common to all four suits that is used to distinguish each card in a suit from the other twelve, I now display on each card specific identifying indicia which uniquely distinguishes each card from all other cards in the deck while, at the same time, falling within the particular trump-determining category of the suit within which the card is located. The latter indicia determines the so-called trump word within the trump suit and it can comprise either a word or words or a picture or a word or group of words and matching picture.

5 Claims, 2 Drawing Figures

CARD GAME WITH TRUMP SUITS AND TRUMP WORDS

In my U.S. Pat. No. 4,234,189, I disclose a card game in which the trump suit selection is predicated upon paired parts of speech, there being some eight principal parts of speech in the English language as well as some others. More specifically, the deck consisted of 52 cards divided into four suits of 13 cards per suit. The four suits were noun/pronoun, verb/interjection, preposition/-conjunction and adjective/adverb. In addition, each card in each suit carried a paired-letter designation such as A/B, C/D, E/F, etc. covering all 26 letters of the alphabet. One player, usually the dealer, has the option of selecting the trump suit and a so-called "trump word" within the chosen trump suit, the latter being any word which is one of the two parts of speech in the trump suit. If, for example, noun/pronoun was chosen as the trump suit, the word "she" might be selected as the trump word since it is a pronoun. Since the letters of the chosen trump word are ranked higher than other letters for scoring purposes, the player who has the right to pick the trump suit and trump word naturally makes this selection based upon the words he or she can make from the letter cards in his or her hand and then select the trump suit to correspond to the part of the speech of the selected word.

Many interesting and challenging variations on the central theme of the game described above are possible, however, they all involve the ability on the part of each player to distinguish among the eight parts of speech and tell which one the selected trump words fall into. Unfortunately, I have discovered that this requirement eliminates a vast population of potential players, especially young children, who have yet to learn the parts of speech. Also, with no words displayed on the cards other than the parts of speech themselves, the player is required to not only choose a word but to know how it is spelled. Again, for the young people, this may impose an impediment that goes beyond their present level of education or skills in this area.

I have now discovered in accordance with the teaching found herein that these and other shortcomings of the more sophisticated forms of my card game can, in large measure, be overcome by eliminating the parts of speech as the suit-determining factor and replacing them with other simpler and more widely recognized categories, especially by young children who have yet to acquire the skills necessary to participate meanfully in the patented version of my game. In the preferred form of my game, I also supply the player with at least one trump word spelled out on each card, it being either the trump category itself or one of thirteen species falling within such category. The paired-letter designations are retained and it becomes a simple matter for the young player to match letters of the printed words with the paired-letter designations to select a proper trump suit and trump word without having to be able to spell. Little, if any, of the educational values of the game is lost or sacrificed. Instead, it is recast so to speak on a somewhat lower educational and/or skill level.

Accordingly, it is the principal object of the present invention to provide a novel and improved card game.

A second objective is the provision of a game of the class described which requires only the bare minimum reading skills to participate.

Another object of the invention herein disclosed and claimed is to provide a card game using trump suits and associated trump words that is so versatile it can be tailored to any subject category capable of being divided into thirteen subcategories or species within the main category even though the remaining three categories share no common theme with one another.

Still another object is to provide a card game of the type aforementioned in which the player is provided with all the information necessary to play, but not necessarily score, at least the simpler versions of the game on the cards themselves.

An additional object is the provision of a card game that is susceptible of being played at different levels of expertise, education and training as well as with different numbers of players, all with the same deck.

Further objects are to provide a trump-type card game which is clever, stimulating, challenging, easy to learn and play, capable of being scored in various ways, free of boredom and readily adaptable to languages other than English.

Other objects will be in part apparent and in part pointed out specifically hereinafter in connection with the description of the drawings that follows, and in which.

Figure 1:
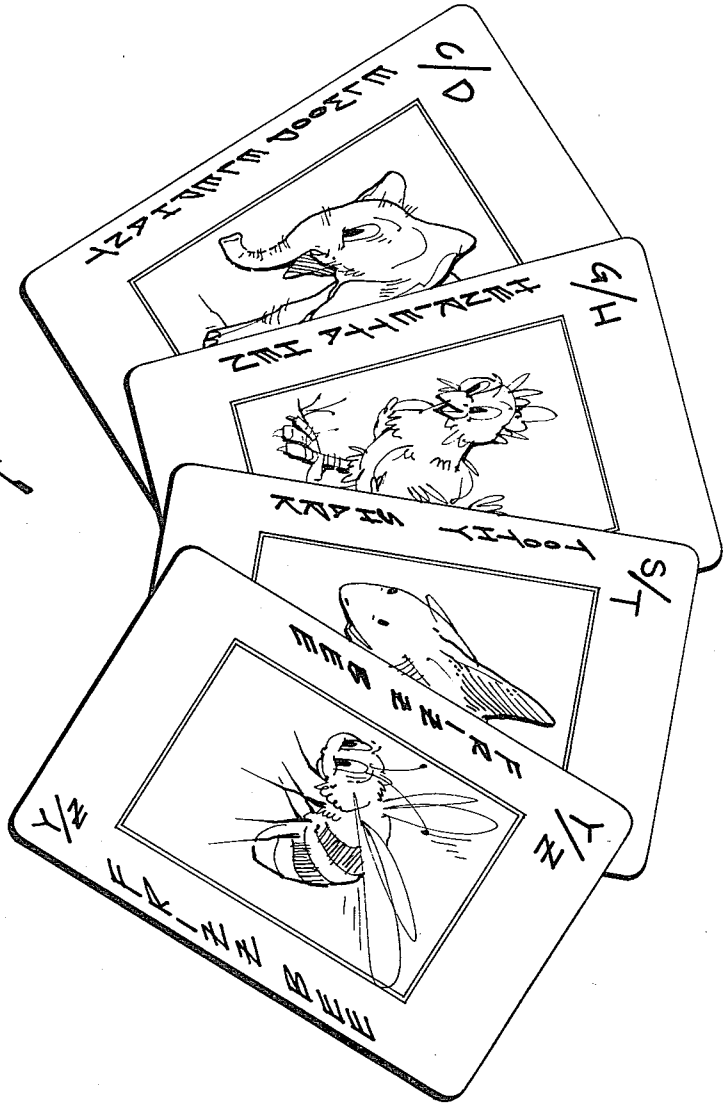
FIG. 1 is a representative card showing species of all four trump suits.

Referring next to the drawings for a detailed description of the present invention and, initially, to FIG. 1 for this purpose where four representative cards are shown each representing one of four different trump suits, the first being for purposes of illustration the Animal suit, the second the Birt suit, the third the Fish suit, and the fourth the Insect suit. The respective suits are identified by each card in the suit displaying a specie of the genus or category making up the suit. A 52 card deck is used divided into four suits of thirteen cards each, all thirteen cards of each suit being of like suit designator, e.g. Animal, Bird, Fish, or Insect. These suit-determining categories are, of course, merely illustrative of a near infinite variety of subject categories that can form a genus for differentiating one suit from another capable of being subdivided into at least thirteen different species. One might, for example, select as categories major league baseball teams or National Football League teams and use as species thirteen of the players on a chosen team. Art, history, motion pictures, cartoon characters, geography and a myriad of other subjects provide a suit-determining category pool that encompasses subjects having an appeal for almost any age group, special interest group, education level, and even those of different nationalities that speak languages other than English including those using different alphabets provided that they can be subdivided into a whole number multiple of thirteen characters as will become apparent presently.

The card shown selected from Animal suit carries two additional designations, the first being a unique two-letter designation (C/D as shown) having no counterpart in the same suit but having identical counterparts in the other three suits. The second designation is the specie designation within the suit-designating category or genus which, as illustrated, is an elephant in the Animal suit. This specie designation differs from the two-letter designation in that it occurs only once in the entire 52 card deck. The noun describing the specie illustrated on the card appears in the left-hand margin of the card as shown and it remains visible when the cards are held in the customary "fan-forming relation customarily used. In addition, while the picture may not be visible except on the uppermost card of the hand, at least the first letter of the double-letter designator will be visible in the upper left-hand corner above the noun naming the specie. Since in the particular form illustrated, the double-letter designators follow one another in alphabetical order, the second is obvious even though hidden when the first can be seen.

In place of the noun identifying the specie broadly like, for example, elephant, dog, ant, robin, trout, shark, etc., one might substitute given names which are associated by the players with the particular species illustrated such as, for example, in a baseball suit showing a picture of Babe Ruth and using his name in place of the word "baseball" or some other more generic specie-designator in the left margin of the card. In fact, as a teaching tool, a combination of both has advantages like, for instance, Hoppity Kangaroo, Tweedie Canary, Doris Dolphin, and the like. Regardless, each card must carry at least one specie designator in the form of either a word or group of words or a picture which differentiate it from all other cards in the deck, preferably both. Thus, as shown in FIG. 1, we have ELWOOD ELEPHANT appearing on the C/D card in the Animal suit along with a cartoon representation of Elwood; HENRIETTA HEN appearing on the G/H card in the Bird suit along with a pictorial representation of Henrietta; TOOTHY SHARK on the S/T card in the Fish suit together with a drawing of Toothy; and, lastly, FRIZZ BEE on card Y/Z in the Insect suit together with his picture. These four cards are representative of different approaches that can be taken to the specie designation. In the case of the Bird suit, the noun identifying the specie, her given name and one letter of the double-letter designator all include the letter H. This approach is helpful in teaching youngsters the alphabet and how to spell.

The Animal suit represents a second approach where both the noun designating the specie and the given name for the particular member of the specie both being with the letter E; however, the double-letter designator is chosen at random and includes no "E". The third approach as might be expected is to have one or both words in the given name/specie designator in common with a letter of the double-letter designator but with the two words beginning with different letters as in the case of Toothy Shark on the S/T card. Finally, we have Frizz Bee on the Insect card where the given name and specie name differ from one another in their first letters and also differ from either letter of the double-letter designator. This will be the most common form of the invention when the names of people engaged in some common endeavor giving rise to the suit designator are pictured and named like the Babe Ruth example previously given.

If, for example, the given names have become sufficiently well known such as, for example, many of the Walt Disney cartoon characters like Snow White, Dumbo, Monstro, Dopey, Pluto, Mickey, Daisy, Donald, etc., no specie designator is needed since the player is already well aware of the fact that these given names are associated with elephants, ducks, whales, dwarfs, etc. In these instances, of course, a picture of the particular cartoon character would appear on the card along with his, her or its given name.

No useful purpose would be served by illustrating all 52 species; however, the following list is one that might be used:

TABLE I

| | ANIMAL | BIRD | FISH | INSECT |
|---|---|---|---|---|
| A/B | Bear | Pheasant | Sam Clam | Mosquito |
| C/D | Elwood Elephant | Baldy Eagle | Halibut | Ms. Ladybug |
| E/ | Dog | Raven | Trout | Spider |
| G/H | Racoon | Henrietta Hen | Perch | Centipede |
| I/J | Kangaroo | Crow | Oyster | Cricket |
| K/L | Cat | Robin | Grabby Crab | Ella Ant |
| M/N | Squirrel | Snipe | Lobster | Bat Gnat |
| O/P | Snake | Pigeon | Whitefish | Scorpion |
| Q/R | Horse | Sparrow | Dolphin | Butterfly |
| S/T | Elk | Wren | Toothy Shark | Moth |
| U/V | Speedy Sloth | Hawk | Bass | Fly |
| W/X | Cow | Gus Gull | Yellowtail | Roach |
| Y/Z | Bruce Moose | Lark | Salmon | Frizz Bee |

Given names have not been given to each named species because such names are, for the most part, purely arbitrary unless selected in the manner aforementioned to correspond with well-known people, places, events, etc.

Figure 2:
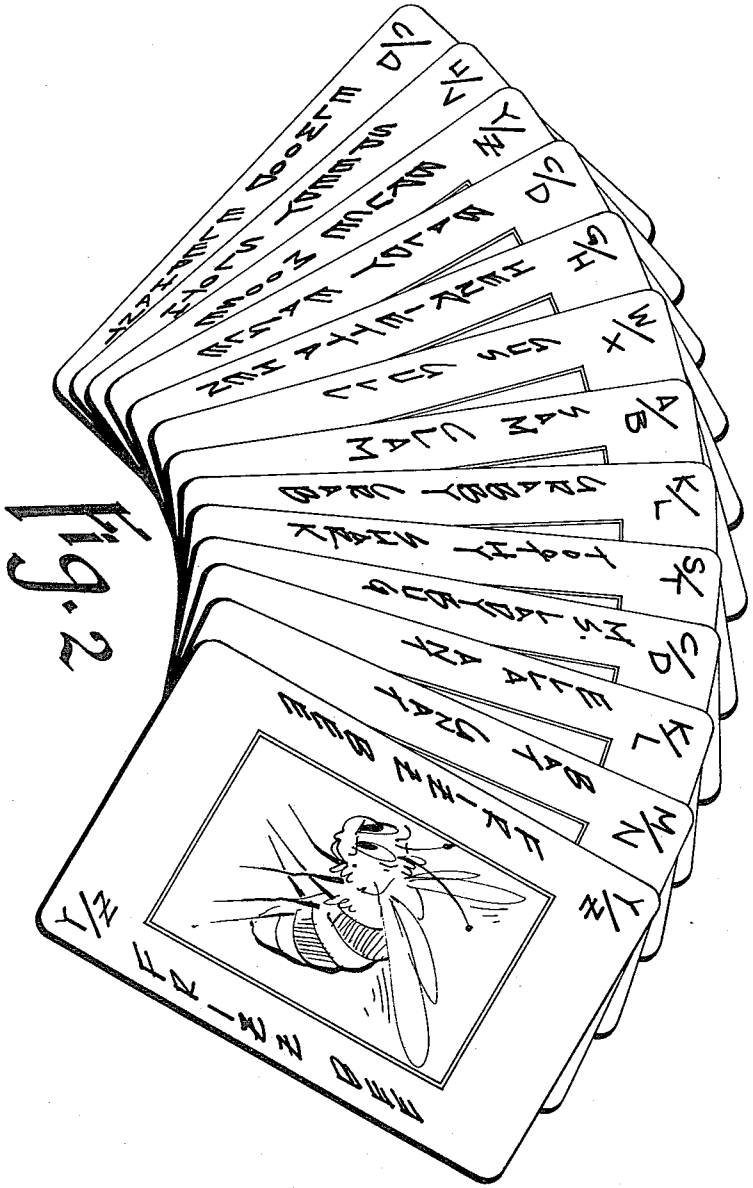
FIG. 2 is a sample hand of thirteen cards.

Next, with reference to FIG. 2 when a representative hand of thirteen cards has been shown, the manner in which the trump suit is selected and the relative value of the individual cards determined by a specie designator will be set forth in detail. For this purpose, the hand will be seen to contain the four cards shown in FIG. 1 together with nine additional cards selected from the above list, the latter cards having been supplied with an arbitrarily selected given name for purposes of illustration. Accordingly, we have a hand of thirteen cards as follows:

Animal Suit

C/D Elwood Elephant
U/V Speedy Sloth
Y/Z Bruce Moose

Bird Suit

C/D Baldy Eagle
G/H Henrietta Hen
W/X Gus Gull

Fish Suit

A/B Sam Clam
K/L Grabby Crab
S/T Toothy Shark

Insect Suit

C/D Ms. Ladybug
K/L Ella Ant
M/N Bat Gnat
Y/Z Frizz Bee

Now, in the play of the game, the first thing that is done is to deal the cards. If four players are playing, all the cards in the deck are dealt giving each player a hand containing thirteen cards. In the version using three players, each player is dealt seventeen cards with the remaining card left face down in the center of the table. Since all cards have a point value in the game, it is agreed upon by the players who receives the odd card such as, for example, the player playing the first or last trick. In the two player version since 26 cards are too many to conveniently hold, hands of thirteen cards each are preferably dealt to the players and the remaining 26 left in a stack in the center of the table. As each trick is taken by a player, he or she also takes a card from the stack which adds to his or her point total and, obviously, exhausts the stack as the last trick is played.

The next order of business is the determination of the trump suit and the trump word. In the more difficult versions of the game, the trump suit is arrived at by each player in turn bidding a number of points such player feels can be taken in the form of tricks during the play phase provided he or she gets the right to name the trump suit and the trump word. As in most bidding games, a good deal of experience is required to assess one's point-winning potential with a particular hand, therefore, simpler methods of selecting trump are often used for the young and/or inexperienced player which do not involve a bidding process but instead are arbitrary such as the dealer, the player to the left of the player who won the last hand, or some such designation which either provides all those playing with an equal trump suit and trump word naming opportunity or, alternatively, is left mainly to chance. Regardless, one of the players is selected to name the trump suit and the trump word.

For purposes of the present explanation, it will be assumed that one of the players in a two or four-handed game has been dealt the hand of FIG. 2 and that he or she has somehow become the person who gets to name the trump suit and the trump card by one of the processes of selection previously noted. Unlike most other card games, the cards not only are ranked but they have different values. Moreover, these ranks and values are not fixed but instead vary with the trump word. Accordingly, selection of both the trump suit and the trump word are dependent upon a knowledge of the scoring so that these elements can be chosen with an eye to maximizing the point score which score ultimately is used to determine a winner. Accordingly, before analyzing the sample hand of FIG. 2 to determine what the best trump suit and trump word should be, it will be meaningful to first examine the basic scoring system.

The trump word is either the single word or one of the two words printed on the left margin of each card, one of these words being the noun describing the particular specie illustrated thereon and the second word, if any is used at all, being the given name or adjective or title or whatever used in conjunction with the specie-defining word to further define same. For example, while the noun "elephant" alone could appear in the margin of the C/D card in the Animal suit, this noun could be further modified by other words like "Elwood" as shown or, alternatively, words like "fat", "grey", "Sir", "African" or "Asian", etc., to provide a second trump word selectable by the player as an alternative to the word "elephant". In this particular simplified version of my patented word game, however, the trump word must appear upon the card and not be one chosen arbitrarily from an outside source that merely answers the requirement of being a part of speech corresponding to that particular part of speech chosen as the trump suit such as, for instance, a word like "castle" when the trump suit selected was the "noun" classification. This considerably simplifies the game and, most significant, the player has before him or her the word spelled out. The advantages of such a game as a learning tool are self-evident.

Now, in a chosen trump word, the first letter of the word receives the highest point value followed by the second and so on down to the end. Moreover, the cards carrying the letters of the trump word are also the highest valued cards in all suits, not just the trump suit. If, perchance, the trump word contains two letters on the same card like "DOCTOR", then the point value of the C/D cards would be determined by the letter "D", not the "C" since the "D" appears first in the word.

After the cards bearing the letters in the trump word are ranked, the remaining cards are, preferably ranked in some easily recognizable fashion such as in alphabetical or reverse alphabetical order although, obviously, other ranking systems could be employed.

During play, the player who has won the bid or otherwise been selected to name the trump suit and trump word leads the first card. Each player in succession must either follow suit or trump. The highest card played on the trick wins the trick unless a trump card has been played in which event the highest trump wins. The winner of a given trick leads the play for the next trick. If a player cannot follow suit and is also out of trump, he or she may discard.

In scoring, a greater number of points is given for playing a card with a single letter of the trump word on it when compared with cards carrying letters which are not present in the trump word, all of which carry the same point value even though their rank or trick-taking potential is different. A single card carrying two letters of the trump word is given a point bonus over those having only one. Bonus points are also preferably awarded for forming the entire trump word in any suit card and an even higher bonus for forming the entire trump word in the trump suit. If desired, bonus points can be awarded for forming syllables of the trump word; however, this makes the game somewhat more complicated for all but experienced players.

Knowing the aforementioned scoring system allows the players to assess the point-taking potential of their hands as well as its bidding potential should the bidding point system be used to determine who among the players gets to name the trump suit and the trump word. With this in mind, and assuming no bonus credit is given for syllables of the trump word, the information is now available with which to evaluate the hand of FIG. 2.

If, for purposes of illustration, it is assumed that:

1. One point is awarded for each card in any suit which has no letters in the trump word;
2. Three points are awarded for each card in any suit which contains a single letter of the trump word; and,
3. Five points are awarded for each card containing two or more letters of the trump word, then a player might evaluate the potential of his or her hand as follows based upon rules 2 and 3 above. First of all, the following cards have no bonus point potential, i.e. above one point, since they are not found in the players hand:

E/F
I/J
O/P
Q/R

There is one each of the following cards:

A/B
G/H
M/N
S/T
U/V

W/X
two each of:
K/L
Y/Z
and three of:
C/D
therefore, with a choice of two possible trump words on each card, the thirteen cards in the sample hand would be evaluated as follows with the total point value of each word appearing in parenthesis to the right of the word:

TABLE II

| Card | Word One | (Total One) | Word Two | (Total Two) |
|---|---|---|---|---|
| 1 | ELWOOD | | ELEPHANT | |
| | 033099 | (15) | 03003333 | (15) |
| 2 | SPEEDY | | SLOTH | |
| | 300096 | (18) | 56053 | (19) |
| 3 | BRUCE | | MOOSE | |
| | 30390 | (15) | 30030 | (6) |
| 4 | BALDY | | EAGLE | |
| | 55696 | (31) | 03360 | (12) |
| 5 | HENRIETTA | | HEN | |
| | 303000553 | (19) | 303 | (6) |
| 6 | GUS | | GULL | |
| | 333 | (9) | 3 3 10 10 | (26) |
| 7 | SAM | | CLAM | |
| | 333 | (9) | 9633 | (21) |
| 8 | GRABBY | | CRAB | |
| | 305556 | (24) | 9055 | (19) |
| 9 | TOOTHY | | SHARK | |
| | 500536 | (19) | 33306 | (15) |
| 10 | MS. | | LADYBUG | |
| | 33 | (6) | 6596533 | (37) |
| 11 | ELLA | | ANT | |
| | 0 10 10 3 | (23) | 333 | (9) |
| 12 | BAT | | GNAT | |
| | 533 | (13) | 3333 | (12) |
| 13 | FRIZZ | | BEE | |
| | 000 10 10 | (20) | 300 | (3) |

As is evident from Table II, "LADYBUG" has by far the highest point total (37) followed closely by "BALDY" with 31. The next group, "GULL", "GRABBY" and "ELLA" are all well back. Unfortunately, the player holding this hand is in a rather poor position to control the bidding since it (the hand) has as even a distribution of suits as it is possible to get, specifically, three cards each of the Animal, Bird and Fish suits with the remaining four, of course, in the Insect suit. On the other hand, "LADYBUG" is in the Insect suit along with "ELLA". The Bird suit contains two high point words, namely, "BALDY" and "GULL" as does the Fish suit with both "GRABBY" and "CLAM" closely followed by "CRAB" and "TOOTHY". If either "CLAM" or "CRAB" were chosen as the trump word, the player would have the highest card (C/D) in three of the four suits which is equivalent to three Aces but none of the three is in the Fish suit. There is no Q/R card in the hand either so the player would lose the first two tricks in the Fish suit and, in so doing, also lose his or her 5-point A/B cards, one of which would have to be played on the C/D Fish card and the second on the Q/R Fish card so "CRAB" is a poor choice.

Following the same analysis, "CLAM" is a better word than "CRAB" although, here again, the C/D card of the Fish suit is out which means that the player holding the hand would lead the M/N card on the first trick to force the C/D card out. If the C/D card were played, then the holder of the FIG. 2 hand would be in control of the Fish suit with the K/L card and the A/B card, both of which are in the Fish suit. Assuming even distribution, the player might take three of the four Fish trump tricks and have the controlling C/D card in two of the others (Animal and Insect). These together with the second ranking K/L card in the Insect suit, might account for somewhat around six tricks. Most of the remaining cards are well toward the end of the alphabet and have almost no trick-taking potential except for the S/T card in the Fish suit which is good for one more trick giving a total of seven.

Finally, assessing the Insect suit with "LADYBUG" as the trump word, we immediately find that the holder of the FIG. 2 hand has the top K/L card along with the top card in the Fish suit. The A/B card is missing but a lead of the third-ranked C/D card would likely cause it to fall in which event the fourth ranking Y/Z card would be good. The A/B card has already been played, persumably, so that makes the U/V card the next highest one followed by the G/H card. The chances of both of these cards falling to make the remaining M/N trump card good are really quite remote. A far better possibility is that one of these two cards will be left in another player's hand so that the FIG. 2 hand will lose the M/N card. Also, the E/F and O/P cards in the Insect suit rank ahead of the M/N card so the chances are that only two trump suit tricks will be taken in the Fish suit. The other suits, however, offer some promise.

The player of the FIG. 2 hand holds the highest card in the Fish suit which is good for one more trick or three to this point. The second ranking card in the Fish suit (A/B) is also present which increases the total to four. In both the animal and Bird suits, one player holds the third ranking C/D card protected by two others which, presumably, would be played upon the K/L and A/B cards in these suits. It would seem, therefore, that there are six sure tricks in the hand using Insects as the trump suit and "LADYBUG" as the trump word. The Y/Z, or fourth ranked card in the Animal suit, is also in the hand which has some potential as the seventh trick. In fact, both the U/V card in the Animal suit and the G/H card in the Bird suit are found in the trump word and, as such, take precedence over any of the cards carrying letters that are not in the trump word; therefore, chances are that "LADYBUG" in the Insect suit for seven tricks is probably a better bid than "CLAM" in the Fish suit. This, coupled with the fact that "LADYBUG" is the highest point word would suggest that it is the better choice of the two. Moreover, having the top ranked K/L card in the Insect suit, capturing the high point cards using Insect as the trump suit seems to be the better choice. Bonus points can be given for capturing all the letters in the trump word which adds yet another factor to be considered even though in the present illustration, the proper decision would likely remain the same.

From the foregoing, it can be seen that a challenging card game results in which all the choices available to the player are fixed as opposed to my previous one where the players were free to chose other trump words than those displayed upon the cards. As such, the instant game has a wider appeal, the potential of almost unlimited subject matter and tremendous teaching potential.

What is claimed is:

1. In a card game of the type having a deck of fifty-two playing cards, suit-determining means displayed on each card dividing the deck thereof into four suits of thirteen cards each, said suit-determining means defining a unique category containing at least thirteen species, and card-ranking means common to all four suits for determining the rank of a card within a suit displayed on the face thereof, the improvement which comprises: unique indicia displayed by each card for distinguishing same from all other cards in the deck, said indicia comprising a specie within one of the suit-determining categories, letter designators on each card defining the card-ranking means, and a word or words made up of said letter designators displayed on said card uniquely associated with each specie, one of said words being selectable as a trump word, the order of the letters in the selected trump word cooperating with said letter designators in accordance with a predetermined scoring system to provide a measure of the trick-taking potential of a group of such cards in a hand dealt one of the players.

2. The improved card game as set forth in claim 1 wherein: one of said words selectable as a trump word comprises a noun identifying the displayed species.

3. The improved card game as set forth in claim 2 wherein: another of said words is an adjective qualifying said noun.

4. The improved card game as set forth in claim 1 wherein: each card carries a pictorial representation of a species.

5. The improved card game as set forth in claim 1 wherein: the letter designators means comprise pairs of letters.

* * * * *